US006130197A

United States Patent [19]

Bedford et al.

[11] Patent Number: 6,130,197

[45] Date of Patent: Oct. 10, 2000

[54] HARD SURFACE CLEANER

[75] Inventors: David Bedford; Susan Wigley, both of Hull, United Kingdom

[73] Assignee: Reckitt & Colman Products Limited, Winsdor, United Kingdom

[21] Appl. No.: 09/297,492

[22] PCT Filed: Nov. 14, 1997

[86] PCT No.: PCT/GB97/03133

§ 371 Date: Apr. 30, 1999

§ 102(e) Date: Apr. 30, 1999

[87] PCT Pub. No.: WO98/22562

PCT Pub. Date: May 28, 1998

[30] Foreign Application Priority Data

Nov. 16, 1996 [GB] United Kingdom ..... 9623823

[51] Int. Cl.[7] ..... C11D 1/66; C11D 3/26; C11D 3/43

[52] U.S. Cl. ..... 510/421; 510/163; 510/179; 510/180; 510/243; 510/499; 510/504; 510/505; 510/506

[58] Field of Search ..... 510/163, 179, 510/180, 243, 421, 499, 504, 505, 506

[56] References Cited

U.S. PATENT DOCUMENTS

| | | | |
|---|---|---|---|
| 4,666,615 | 5/1987 | Disch et al. | 252/11 |
| 4,690,818 | 9/1987 | Puchalski, Jr. et al. | 424/70 |
| 4,784,789 | 11/1988 | Jeschke et al. | 252/174.23 |
| 5,522,942 | 6/1996 | Graubart et al. | 134/40 |
| 5,534,181 | 7/1996 | Henkel et al. | 510/423 |
| 5,627,148 | 5/1997 | Dubief et al. | 510/122 |
| 5,830,481 | 11/1998 | Cauwet-Martin et al. | 424/401 |

FOREIGN PATENT DOCUMENTS

| | | | |
|---|---|---|---|
| 0 109 022 A2 | 5/1984 | European Pat. Off. | C11D 1/831 |
| 0 621 335 A2 | 10/1994 | European Pat. Off. | C11D 1/835 |
| 0 621 335 A3 | 10/1994 | European Pat. Off. | C11D 1/835 |
| 0 698 660 A2 | 2/1996 | European Pat. Off. | C11D 1/62 |
| 1 298 898 | 12/1972 | United Kingdom | C11D 1/72 |
| 2 116 579 | 9/1983 | United Kingdom | C11D 1/66 |
| 2 203 162 | 10/1988 | United Kingdom | C09K 3/16 |

OTHER PUBLICATIONS

International Cosmetic Ingredient Dictionary, 5th ed., Wenninger et al, p. 378, 1993.

Copy of GB Search Report for GB Application No. 9724119.4 dated Mar. 3, 1998.

Copy of GB Search Report for GB Application No. 9623823.3 dated Feb. 6, 1997.

*Primary Examiner*—Gregory R. Delcotto
*Attorney, Agent, or Firm*—Fish & Richardson P.C.

[57] ABSTRACT

A hard surface cleaner comprises (a) one or more alkyl or alkenol ethoxylated amides, (b) a glycol ether or a $C_6$–$C_{11}$ alcohols, and (c) optionally, an anti-static agent.

12 Claims, No Drawings

HARD SURFACE CLEANER

BACKGROUND OF THE INVENTION

The present invention relates to compositions for cleaning hard surfaces, and in particular to compositions suitable for cleaning glass and glossy or shiny surfaces.

A particularly important feature of such compositions is that the surface wnen cleaned must not have any streaks or smears and, although numerous compositions for cleaning glass and like materials have been proposed, providing compositions which clean effectively whilst avoiding streaking or smearing has been a particular technical challenge.

A further desirable feature of cleaning compositions for glass and shiny or glossy surfaces is the ability to reduce or to avoid the build up of static charge. It will be appreciated that the presence of static charge on the surface causes the rapid re-deposition of dust and like particles by attraction of such particles onto the surface from the air. The benefits achieved by cleaning of the surface are thus rapidly diminished.

One known cleaning composition, in particular for glass, comprises an aqueous solution of less than 1% sodium alkyl sulphate and sodium alkyl ether sulphate surfactants together with a grease removing solvent. Whilst this composition shows satisfactory cleaning and non-smearing or non-streaking properties, the composition does not impart anti-static properties to the surface.

European Patent Application EP-A-0621335 discloses aqueous cleaning compositions comprising 0.1 to 10% by weight of a non-ionic surfactant and 3.5 to 10% by wieght of a glycol ether solvent. The compositions are, however, not hard surface cleaning compositions but are instead aimed at achieving broad spectrum anti-microbial activity, an acceptable level of skin irritation and/or an acceptable cleaning efficacy.

DE-A-3614336 discloses hard surface cleaning compositions aimed at imparting an anti-static effect to the surface without smearing. The compositions disclosed comprise an amphoteric co/terpolymer having at least one nitrogen atom per acrylic acid derivative and a surfactant, preferably of the amine oxide type.

Accordingly, the present invention seeks to provide a cleaning composition, in particular for glass and glossy or shiny surfaces, which has good cleaning properties, does not cause smears or streaks, and also has good anti-static properties, that is, the ability to reduce or prevent the build up of static charge on the surface.

SUMMARY OF THE INVENTION

According to the present invention, there is provided an aqueous cleaning composition for hard surfaces comprising by weight,

- 0.1%–0.5% of one or more alkyl or alkenyl ethoxylated amides,
- 1%–10% in total of at least one member selected from the group comprising glycol ethers and $C_6$–$C_{11}$ alcohols and, optionally,
- 0.005% to 0.5% of an anti-static agent.

The compositions may also include minor amounts (usually less than 1%) of further optional ingredients such as fragrances, colourants, and the like, as known in the art.

DETAILED DISCLOSURE

Particularly preferred for use in the present invention are ethoxylated amides having the general structure:

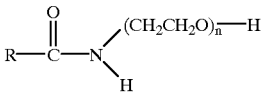

Where R is an alkyl or alkenyl radical having from 10 to 25 carbon atoms, preferably 12 to 22 carbon atoms, and n is preferably an integer in the range of from 10 to 20. Especially suitable are mono-unsaturated alkenyl ethoxylated amides of which oleyl ethoxylated amide and erucic ethoxylated amide are especially preferred. Suitable ethoxylated amides are available in the Cromidets™ series from Croda Chemicals Ltd, UK.

In the preferred formulations, the ethoxylated amides are present in amounts of from 0.1% to 0.5% and more preferably from 0.2% to 0.5%.

The glycol ethers and/or alcohols of the inventive compositions are present in a total amount of from 1% to 10%, more preferably from 3%–6%, and especially from 3.5% to 5.5%. Preferred glycol ethers have the general formula $$R^1—O—CH_2—CH\ (OH)—R^2$$

where $R^1$ is a straight chain or branched lower alkyl radical, preferably having from 1 to 6 carbon atoms and $R^2$ is a lower alkyl radical which may be straight chained or branched and preferably has from 1 to 4 carbon atoms. Particularly preferred glycol ethers are propylene glycol n-butyl ether (butoxypropanol) and propylene glycol methyl ether (methoxylsopropanol). Ethylene glycol monobutyl ether is also efficacious, but is less preferred for environmental reasons.

Whilst formulations comprising essentially the above ethoxylated amides, and glycol ethers and/or alcohols provide excellent cleaning, anti-smear and anti-static properties on surfaces such as glass and many shiny or glossy hard surfaces, a sufficient reduction of the static charge on plastic surfaces (such as vinyl, acrylic or polycarbonate surfaces) may not be achieved. Such static charges are generated by the tribological effects of cleaning the surface with, for example, a cloth and also simply by movement of air across the surface. As mentioned above, dissipation of such static charge is important in order to avoid re-deposition of dust particles from the air. Plastic surfaces are, by their nature, more susceptible than is glass to tribologically induced charge, and this charge is not easily dissipated.

The inventors have found that the static charge on such plastic surfaces after cleaning can be significantly reduced by incorporating an antistatic agent into the above compositions.

The anti-static agents of the invention are water soluble quaternary ammonium compounds which contain a polypeptide chain coupled to fatty alkyl groups. A typical structure of these compounds may be schematically represented as:

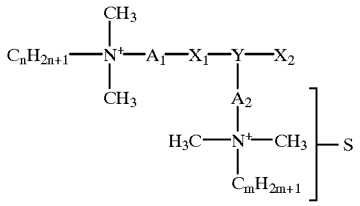

where $A_1$ and $A_2$ are portions of amino acids, $X_1$ is a portion of the polypeptide chain, $X_2$ is another portion of the polypeptide chain ending in a carboxy terminal amino acid, Y represents a carbon atom in the polypeptide chain and n and m may be the same or different and are integers in the range 8 to 20, preferably 10 to 18, especially 12. The anti-static agents may include one or more further side chains S and have a molecular weight of not more than 10,000, preferably not more than about 2000 and especially about 1000. Particularly preferred compounds may be based on collagen or keratin proteins. Especially preferred is a keratin based fatty ($C_{12}$ $H_{25}$) quaternary derivative of hydrolysed keratin (lauryldimonium hydroxypropyl hydrolysed keratin protein) which is commercially available as Croquat K (™) from Croda Colloids Ltd, UK. The antistatic agent is preferably included in an amount of from 0.01% to 0.3%, and especially an amount of from 0.05% to 0.15%.

It is believed that the instant inventive formulations are particularly advantageous with regard to the prior art formulations based on sodium alkyl sulphate and sodium alkyl ether sulphate surfactants in that addition of antistatic agent to formulations including these surfactants results in smearing on cleaning.

Thus, the combination of the ethoxylated amides and the antistatic agent, together with the glycol ethers provides excellent charge reduction on plastic surfaces whilst also avoiding streaking and smearing on the surface. The inventors believe that this combination of charge dissipation and non-streaking/smearing is not achieved by the prior art compositions.

The compositions of the invention may also advantageously include a wetting agent, in particular a fatty alcohol ethoxylate such as Volpo T7™ available from Croda. Such a wetting agent may be present in amounts of from 0.001% to 0.5%, more especially from 0.002% to 0.1%.

The compositions of the invention may also include minor amounts of optional ingredients such as fragrances or colourants, provided that such optional ingredients do not deleteriously affect the anti-smearing or anti-static properties of the compositions.

In order to better illustrate the invention, Examples and Comparative Examples were prepared and tested as illustrated in Table 1 below. Examples 1 and 2 are examples of the invention and Examples V to Z are comparative examples.

In order to assess the level of smearing caused by these formulations, samples of the formulations were applied in predetermined amounts to a clean dry paper towel which was then applied to a clean glass mirror tile and moved once with even pressure across the tile. After allowing the tile to dry, the level of smearing was assessed using a scale of 0 to 4 where 4 indicates severe smears or streaks and 0 indicates no smears or streaks.

The anti-static properties of the formulations were tested using a Charge Decay Test Unit from John Chubb Instrumentation, Cheltenham, UK. The test procedure involves the induction of a static charge on a surface and measurement of the time taken for the charge to dissipate. The latter time is expressed as 1/e and a lower value indicates a higher rate of charge dissipation and better antistatic properties. Tests were carried out on glass and on polycarbonate surfaces and the results are indicated in Table 1 below.

TABLE 1

| Example/Comparative | % w/w | | | | | | |
|---|---|---|---|---|---|---|---|
| Example | 1 | 2 | V | W | X | Y | Z(2) |
| Butoxypropanol | 2.1 | 2.1 | 2.1 | 2.1 | 2.1 | 2.1 | |
| Methoxyisopropanol | 1.8 | 1.8 | 1.8 | 1.8 | 1.8 | 1.8 | |
| Polyoxyethylene (15) oleylamide | 0.3 | 0.3 | 0.3 | | | | |
| Sodium laurylether sulphate | | | 0.29 | 0.29 | | | |
| Sodium lauryl sulphate | | | 0.43 | 0.43 | | | |
| Trideceth 7 | 0.006 | | 0.006 | | | | |
| Quaternised hydrolysed keratin | 0.1 | | 0.1 | | | | |
| Polyethoxy lauryl amide(1) | | | | | 0.3 | | |
| Lactamide monoethanolamide[1] | | | | | | 0.3 | |
| Water | 100% | 100% | 100% | 100% | 100% | 100% | |
| Smearing level | 0.56 | 0.25 | 1.89 | 0.8 | | | |
| Charge dissipation time (glass) | 0.3 | | | | 0.77 | 6.9 | 0.3 |
| Charge dissipation time (polycarbonate) | 47.9 | | | | >600 | >600 | >600 |

(1) Polyethoxy lauryl amide and lactamide monoethanolamide are antistatic agents known in the art.

(2) Commercially available product claiming anti-static properties.

Untreated surfaces were also tested for which the charge dissipation times were: glass 1.6; polycarbonate >600.

What is claimed is:

1. An aqueous cleaning composition for hard surfaces comprising, by weight:

from 0.1% to 0.5% of one or more alkyl or alkenyl ethoxylated amides of the formula:

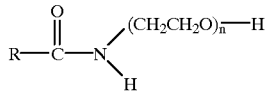

in which R is alkyl or alkenyl having from 10 to 25 carbon atoms and n is an integer in the range of from 10 to 20, from 1% to 10% in total of a member selected from the group consisting of propylene glycol n-butyl ether, propylene glycol methyl ether, a $C_6$–$C_{11}$ alcohol and mixtures thereof, and from 0.005% to 0.5% of an anti-static agent which is a water soluble quaternary ammonium compound comprising a polypeptide chain coupled to fatty acid groups and having the general formula:

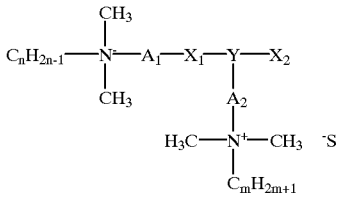

in which $A_1$ and $A_2$ are portions of amino acids, $X_1$ is a portion of the polypeptide chain, $X_2$ is another portion of the polypeptide chain and ends in a carboxy terminal amino acid, Y represents a carbon atom in the polypeptide chain, n and m may be the same or different and each is an integer in the range of from 8 to 20, and S denotes a side chain.

2. A composition according to claim 1 wherein the ethoxylated amide is oleyl ethoxylated amide and/or erucic ethoxylated amide.

3. A composition according to claim 1 wherein the ethoxylated amide is present in an amount of from 0.2% to 0.5%.

4. A composition according to claim 1 which comprises propylene gycol n-butyl ether and/or propylene glycol methyl ether in an amount of from 3.5% to 5.5%.

5. An aqueous cleaning composition for hard surfaces comprising, by weight:

from 0.1% to 0.5% of one or more alkyl or alkenyl ethoxylated amides of the formula:

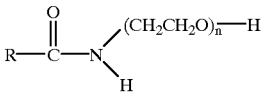

in which R is alkyl or alkenyl having from 10 to 25 carbon atoms and n is an integer in the range of from 10 to 20, from 1% to 10% in total of of propylene glycol n-butyl ether, propylene glycol methyl ether, a $C_6$–$C_{11}$ alcohol and mixtures thereof, and as an anti-static agent, from 0.005% to 0.5% of lauryldimonium hydroxypropyl hydrolysed keratin protein.

6. A composition according to claim 1 which further comprises from 0.001% to 0.5% of a wetting agent.

7. A composition according to claim 6 in which the wetting agent is a fatty alcohol ethoxylate.

8. A composition according to claim 5 wherein the ethoxylated amide is oleyl ethoxylated amide and/or erucic ethoxylated amide.

9. A composition according to claim 5 wherein the ethoxylated amide is present in an amount of from 0.2% to 0.5%.

10. A composition according to claim 5 which comprises propylene glycol n-butyl ether and/or propylene glycol methyl ether in an amount of from 3.5% to 5.5%.

11. A composition according to claim 5 which further comprises from 0.001% to 0.5% of a wetting agent.

12. A composition to claim 11 in which the wetting agent is a fatty alcohol ethoxylate.

* * * * *